US005799817A

United States Patent [19]

Sharp

[11] Patent Number: 5,799,817

[45] **Date of Patent: *Sep. 1, 1998**

[54] STORAGE TANK SYSTEMS WITH ENCAPSULATED FLOW PATHS

[76] Inventor: Bruce R. Sharp, 1741 Hawaii Ct., Marco Island, Fla. 33937

[ * ] Notice: The term of this patent shall not extend beyond the expiration date of Pat. No. 5,628,425.

[21] Appl. No.: 602,978

[22] Filed: Feb. 16, 1996

[51] Int. Cl.[6] ..... B65D 90/02

[52] U.S. Cl. ..... 220/414; 220/457; 220/453

[58] Field of Search ..... 220/453, 454, 220/455, 456, 457, 414, 589, 590, 588, 586, 469, 565, 426, 468, 645

[56] References Cited

U.S. PATENT DOCUMENTS

| | | | |
|---|---|---|---|
| 2,482,366 | 9/1949 | Potters | 220/426 |
| 3,335,903 | 8/1967 | Anderson . | |
| 3,851,786 | 12/1974 | Kaempen . | |
| 3,915,776 | 10/1975 | Kaempen . | |
| 4,780,947 | 11/1988 | Palazzo . | |
| 4,844,287 | 7/1989 | Long . | |
| 4,989,447 | 2/1991 | Gelin . | |
| 5,020,687 | 6/1991 | Seizert | 220/645 |
| 5,025,943 | 6/1991 | Forsman | 220/455 |
| 5,224,621 | 7/1993 | Cannan, Jr. et al. . | |
| 5,261,764 | 11/1993 | Walles | 220/469 |
| 5,387,455 | 2/1955 | Hörsch | 220/454 |
| 5,553,734 | 9/1996 | Sharp | 220/590 |
| 5,628,425 | 5/1997 | Sharp | 220/457 |

*Primary Examiner*—Stephen J. Castellano
*Attorney, Agent, or Firm*—Charles R. Wilson

[57] ABSTRACT

A storage tank system has two closely associated discreet walls with closed communication flow paths therebetween. The system comprises (a) a tank having a main body side wall and attached end walls and (b) a composite wall which substantially follows the contour of at least a portion of the tank. The composite wall includes a base layer of filament bundles. The base layer is bonded to a tank wall by a resinous material and is covered by additional resinous material. A mid-portion of the filament bundles found in the base layer is in a substantially unbonded state to create the closed communication flow paths for leak detection purposes. The strength of the storage tank system is substantially enhanced by the composite wall.

45 Claims, 9 Drawing Sheets

STORAGE TANK SYSTEMS WITH ENCAPSULATED FLOW PATHS

This invention relates to storage tank systems and a method of making storage tank systems. More particularly, the invention relates to underground and above ground storage tank systems wherein a storage tank has a composite wall with encapsulated flow paths overlying at least a portion of the storage tank.

BACKGROUND OF THE INVENTION

Several methods of building double walled storage tanks primarily for storing liquids have been devised. Much of the activity has been in recent years. This is because double walled tanks are now mandated to ensure adequate containment of stored liquid. Leakage through one wall will not immediately cause an environmental problem since the second wall should then serve to contain it. However, to be effective, any wall damage sufficient enough to allow leakage must be detectable so that the damage can be remedied. It is important that means be provided between the double walls that will alert the owner/operator of the tank of any wall failure.

U.S. Pat. Nos. 4,561,292, 4,640,439, 4,644,627, 4,744,137, 4,780,946, 4,780,947 and 4,844,287 disclose double walled storage tank systems wherein means are used to maintain a spaced relationship between the walls of the tanks. The spaced relationship is needed for effective leak detection purposes. However, the spacing means suggested can require a separate time consuming step in properly positioning some specially constructed material on a tank wall prior to forming another tank wall. U.S. Pat. Nos. 4,859,262 and 4,871,078 disclose double walled storage tank systems which also use special materials, though the systems are more efficiently built.

U.S. Pat. Nos. 4,989,447 and 5,000,342 disclose still other double walled storage tank systems. A separating material is used between the walls of the disclosed systems to ensure leakage detection capability. The disclosed systems also recognize the advantage of structurally-bonding or tieing the walls together for strengthening purposes. For example, U.S. Pat. No. 4,989,447 teaches the use of a porous material such as a needled non-woven fibrous material between the walls. A binder saturates the porous material so as to bond the fibers together and to the inner and outer walls of the tank system. The binder present in the porous material bonds the fibers together in a manner which permits wicking of any leakage. U.S. Pat. No. 5,000,342 uses a special separating material having spaced holes extending through it. Formation of an outer wall of the tank with a liquid uncured resinous material also fills the holes which upon cure forms resin attachment columns. The columns are attached at one end to the inner tank and at the other end to the outer wall. The latter described tank system in particular is economically feasible and provides an integrally strengthened tank system.

In a continuing effort to build storage tank systems more efficiently, there has been developed storage tank system having a minimal closed communication space between walls. The resultant tank systems are capable of withstanding elevated pressure forces between the walls without suffering damage.

SUMMARY OF THE INVENTION

A storage tank system comprises (a) a tank having a main body side wall and attached end walls and (b) a composite wall which is adhered to and overlies at least a portion of the tank. The composite wall is bonded to a wall of the tank. It includes a resinous material and a base layer of filament bundles disposed therein. A mid-portion of each of the filament bundles is in a substantially unbonded state to create closed communication paths. Any leakage of the tank wall or of the composite wall will be detectable in the closed communication paths. The walls of the storage tank system are able to withstand substantial pressures without incurring damage. The invention is useful in building new tanks and retrofitting existing buried tanks.

DETAILED DESCRIPTION OF THE INVENTION

Figure 1:
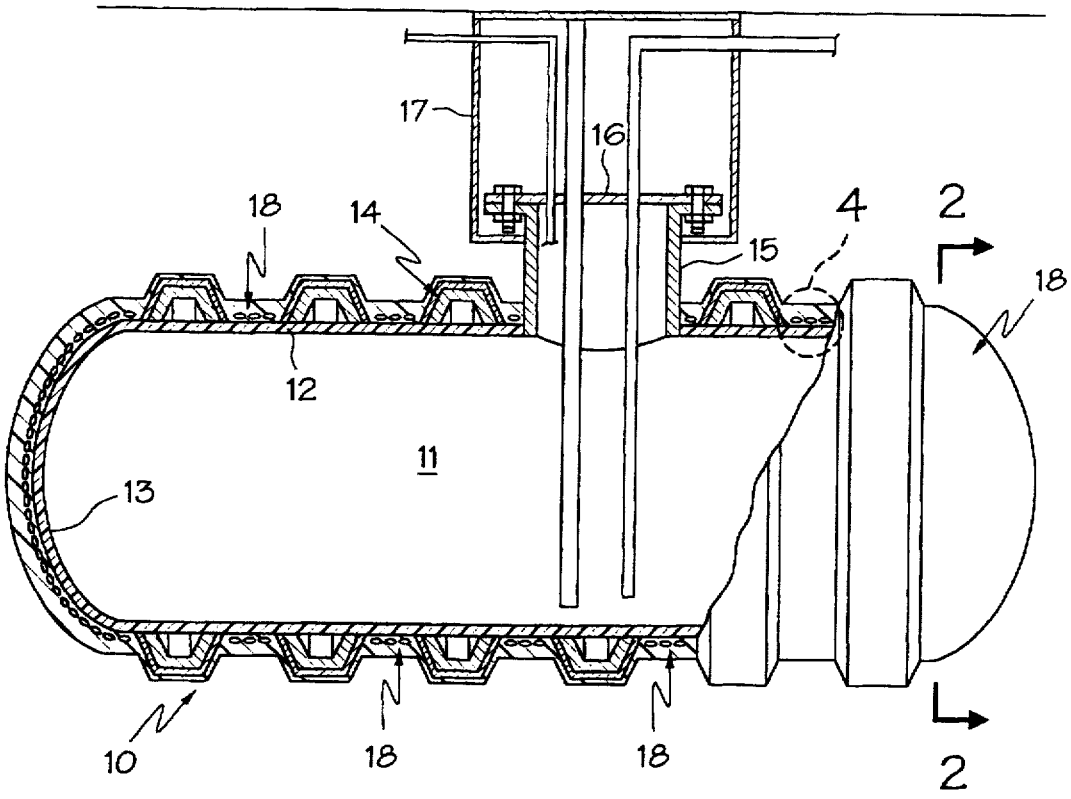
FIG. 1 is a side view in partial section of a storage tank system of the invention having a ribbed inner tank of fibrous reinforced resinous material and a composite wall thereover.

While the description to follow describes the invention in terms of its use with storage tanks for holding gasoline, it should be understood the invention has applicability for other uses as well. The invention lends itself particularly well to underground storage tanks for storing liquid gasoline and, therefore, this preferred use is described in the immediately following paragraphs. An above ground tank utilizing the invention is described with reference to FIG. 18.

Single wall storage tanks which are well known and have been widely used can be utilized in forming the storage tank systems of the invention. The single wall tanks are typically made of metal or a fibrous reinforced resinous material. Either type of tank has use in this invention. They typically hold at least about 500 gallons of liquid. Tanks having capacities of from about 1,000 to about 10,000 gallons of liquid are most common. In accord with this invention, the single wall storage tank has a composite wall formed on either its outside surface or its inside surface. The composite wall covers only portions of the storage tank or covers substantially the full storage tank in accord with special needs as described below and shown in the drawings.

Formation of the composite wall on the inside surface of a tank is a technique which is particularly beneficial in retrofitting existing buried single wall tanks. The interior of such tanks are accessed, cleaned and upgraded to a double walled tank system. Existing buried double walled tanks where the exterior wall has failed are also retrofitted by the method of the invention. The buried single wall and double walled tanks in need of repair do not have to be removed from the ground with consequent costs and station downtime. Rather they are upgraded in place.

With reference to FIGS. 1–4, a storage tank system 10 of this invention utilizes a single wall ribbed storage tank 11 made of a fibrous reinforced resinous material. As evident in FIGS. 1 and 2, the tank 11 is cylindrical-shaped with a main body side wall 12, dome-shaped end walls 13 and circumferentially extending support ribs 14. The support ribs 14 are preferably uniformly spaced along the main body side wall 12 as shown. A single rib which wraps around the main body side wall of the tank in a spiral pattern is also feasible and provides some manufacturing advantages. Sufficient openings can be created in the storage tank 11 to allow for various access lines to communicate with the interior of the tank. As shown, the storage tank 11 has a manway 15 with a removable rigid plate cover 16. A sump 17 positioned on the manway leads to ground surface. The cover 16 has bungs for receiving access lines leading from the ground surface and through the sump 17. For example, a conventional fill pipe, dispensing line and vent pipe enter the storage tank 11 through the cover 16.

Figure 4:
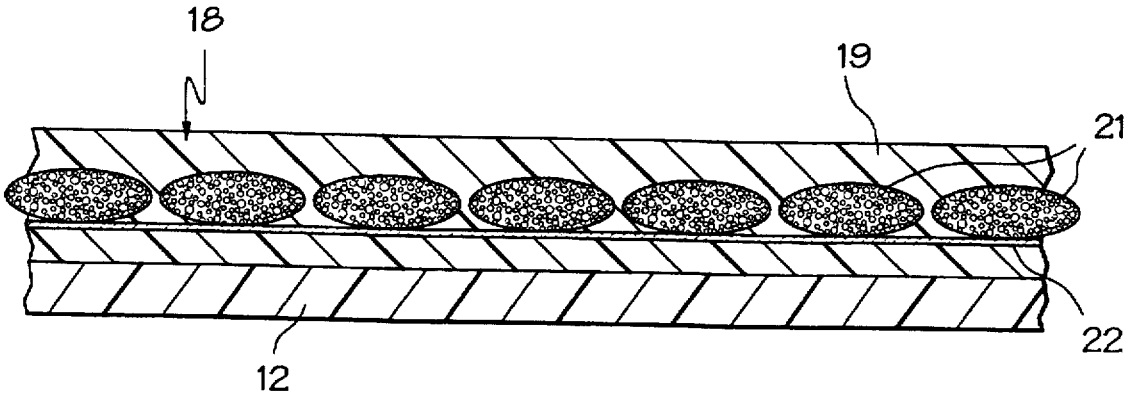
FIG. 4 is an enlarged partial side view in section of the storage tank system of FIG. 1 taken along dotted line 4 thereof showing in detail a storage tank wall with an overlying composite wall.

The illustrated storage tank system 10 also comprises a composite wall 18 over portions of the storage tank 11. The wall 18 is a composite of distinct materials which is formed to create encapsulated flow paths. As best seen in FIG. 4, the composite wall 18 is adhered to the main body side wall 12 of the tank 11. A resinous material 19 and a base layer 20 of discreet filament bundles 21 with preferably a non-woven fibrous backing 22 is a part of the composite wall 18. The base layer 20 with its fibrous backing 22 is encompassed by the resinous material 19. Alternatively, the backing 22 may be any material which holds the bundles 21 together. Such materials include but are not limited to nets, screens, meshes and open cell materials. The composite wall 18 as well as its mode of application are described in detail in the following paragraphs.

Figure 3:
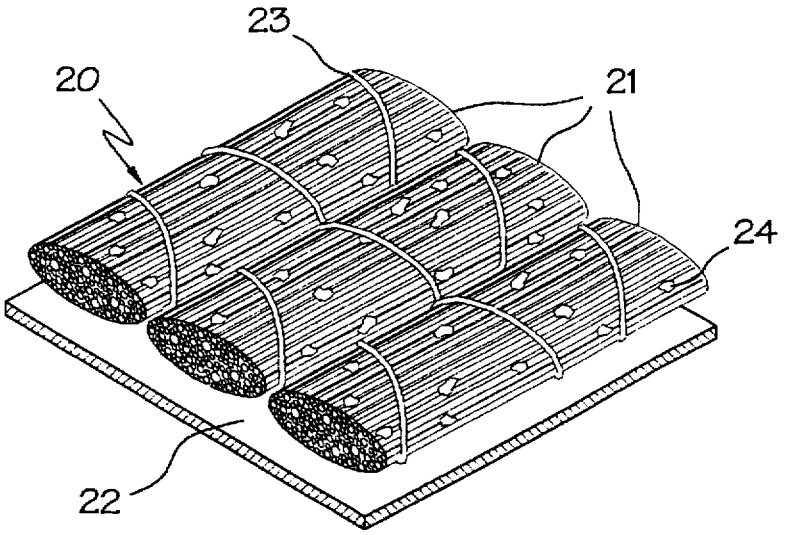
FIG. 3 is a perspective view of a base layer of filament bundles used in construction of the storage tank system of FIG. 1.

The base layer 20 found in the composite wall 18 is comprised of discreet bundles of filaments 21. As best seen in FIG. 3, the individual bundles run generally in one direction. A loose stitching 23 is used to hold the bundles together. Preferably, the fibrous backing 22 loosely tacked to one side of the filament bundles is optionally used alone or along with the stitching as shown to hold the bundles together. The base layer 20 with bundles 21 may be stitched together without backing 22. The bundles must retain their individual integrity at least during building of the storage tank system. Further, and for the same purpose, preferably polyethylene flakes 24 are sprinkled onto the surface of the bundles and then the base layer run through hot rollers. Heat from the rollers melts the flakes and causes a partial sealing as well as a stiffening effect to the filament bundles. Once positioned on the inner tank, the resinous material 19 stabilizes the bundles. Alternatively, other spray materials such as epoxy, polyurethane, latex or other liquid sealant material is applied to the filament bundles to provide partial sealing.

Each filament bundle 21 in the base layer 20 has several continuous filaments which are preferably discreet filaments loosely held together as tows. The individual filaments can also be loosely twisted together to form a full bundle. Further, the individual filaments can be loosely twisted together to form several filament yarns which are then formed into the bundles.

Individual filaments of most interest because of long lasting strength are manufactured filaments made from polymeric synthetic resins or glass. Examples of suitable filaments used to form the bundles include acrylic, nylon, polyester, rayon, acetate, triacetate, olefin and glass filaments. The filaments are solid or hollow and include foamed filaments. Such filaments are preferably substantially inelastic. Preferably, the filaments have denier's, i.e. diameters of from about 3.5 microns to about 24 microns. The filaments are also made from natural fibers such as cotton and wool, though are less preferred because of their ability to absorb moisture and deteriorate over time. The preferred manufactured filaments are more durable. Highly preferred are fiberglass filaments because of their strength characteristics.

Base layers of the bundles have yields of from about 8 oz. per square yard to about 54 oz. per square yard. A preferred array of filament bundles is formed from fiberglass and has a yield of from about 24 oz. per square yard to about 48 oz. per square yard.

Each base layer 20 used in forming the storage tank system shown in FIG. 1 is in the form of a continuous sheet having a width about equal to the distance between support ribs. It can as well be in the form of several strips of sheet material which are abutted side by side on the tank's surface between support ribs. Preferably, the base layer of filament bundles has a yield of about 24 oz. per square yard. It should be understood that tighter or looser individual bundles of filaments can be formed and tighter or looser spacings of bundles can be formed with consequent changes in width, thickness of the bundles, and weight per square yard. A balancing of enhanced performance and costs is readily performed to determine an optimum base layer for the particular tank requirements.

One purpose of the base layer 20 is to provide a means whereby communication paths are created in the composite walls. A lesser purpose of the base layer is to strengthen the wall. To accomplish these objectives, it is important that the density of the filaments which make up the bundles in the base layer and the viscosity of the liquid resinous material used in forming the composite wall be coordinated so that total resin penetration through the individual filaments is avoided to provide flow paths in the mid-portion of each bundle. With reference to FIG. 4, the individual filament bundles of the base layer 20 are embedded in the resinous material 19. Resinous material partially penetrate between individual filament bundles. This partial penetration creates encapsulated filament bundles with a resin-free mid-portion as discussed in the following paragraphs. The partial penetration also aids in structurally tieing the walls together to withstand internal and external load forces.

Mid-portions of the filament bundles of the composite wall 18 forming a part of the storage tank system 10 of FIG. 1 are substantially unbonded and serve as closed communication paths. Such paths provide a means whereby any leakage of liquid or air can be conveyed and/or detected. Wall damage in any part of the storage tank system 10 will cause leakage which will lead to one or more of the communication paths. The communication paths in turn all lead directly or indirectly to a monitoring station. High speed communication paths are preferably added in selected areas of the composite wall to intersect with the aforedescribed filament bundle paths. These high speed communication paths are based on a fibrous or foam-type material which readily transmits liquid or air. This aspect of the invention is further discussed below.

Figure 2:
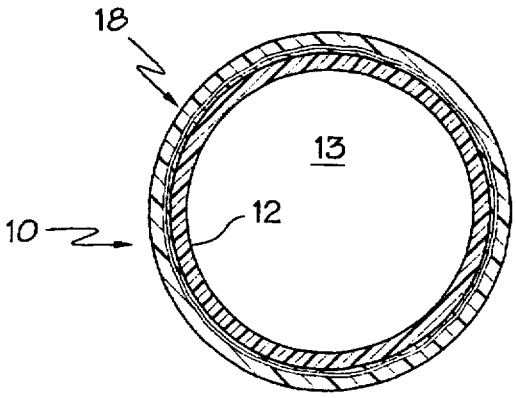
FIG. 2 is an end view of the storage tank system of FIG. 1 taken along line 2—2 thereof.

The storage tank 11 depicted in FIGS. 1, 2 and 4 is built in an efficient manner. Initially, in one manner of building, the side walls 12 in the recessed areas between support ribs and the end walls 13 are substantially coated with a resinous material which will adhere to the tank wall and which is gasoline resistant. Examples of such resins include polyesters, vinylesters, polyurethanes and polyepoxides. Other resins are available and can be used. As aforementioned, the liquid resinous material's viscosity prior to application is adjusted to be viscous and somewhat non-flowable, yet remains tacky sufficiently long enough to position the base layer 20 of filament bundles onto it.

Once the base layers 20 of filament bundles 21 are positioned on the aforedescribed viscous resin coated storage tank 11 and the first face embedded therein in a cured state, another application of viscous resinous material is made. Initially, more resinous material of preferably the same nature as that on the tank's surface is applied to the base layer's second face. Its viscosity is adjusted to also result in only partial penetration.

Most importantly, the resin's penetration through the base layer's first face and its penetration through the base layer's second face are such as to leave the mid-portion of each bundle in a substantially unbonded state. This ensures the continuous closed communication paths which are needed for leak detection purposes. The resin typically flows around the bundles from both sides, though not necessarily equally. Some resin penetration into a filament bundle is possible, though each bundle's mid-portion is in the substantially unbonded state.

Alternatively, in another manner of tank building, the base layer is separately wetted with resinous material and then rolled onto the storage tank 11. The resin wetting is controlled to obtain the above resin penetration and, most importantly, substantially unbounded state in the mid-portion of each filament bundle of the base layer.

The resinous material 19 of the composite wall 18 is preferably fibrous reinforced, though can be the resinous material alone, up to a desired wall thickness. The fibrous reinforcing material when used in the resinous material takes on many different physical shapes and structures variously referred to as mattings, nets, screens, meshes and chopped strands. Examples of fibrous materials commonly used in the FRP industry include fiberglass, polyester, and other synthetic fibrous materials. The particular selection of a fibrous material or a resinous material is dependent on the other material selected and also on the manner of wall formation as known to those in the FRP industry.

Preferably, the composite wall 18 is formed by applying the fibrous material in the form of chopped strands with the resinous materials described previously. That is, the chopped strand and resinous material are sprayed from separate nozzles of the same spray gun until a desired wall thickness is obtained. Trapped air is preferably forced from the formed wall prior to cure. Cure of the resinous materials results in a rigid composite wall capable of containing leaked gasoline should the storage tank wall be damaged. Other known methods of forming a fibrous reinforced resin wall can be used.

The shape of the resultant composite wall 18 is such that, other than the manway 15 and any piping accesses, it covers the main body side wall, including at least a portion of the side walls of the support ribs, and end walls of the storage tank 11. The contour of the storage tank 11 is followed. As shown in FIG. 1, the side walls and top walls of the support ribs are fully covered by overlap of the resinous material 19 of the composite wall 18. A partial covering of the support ribs is also contemplated. In such a case, secondary containment is provided by the composite wall together with the support rib walls, especially the top wall.

The storage tank system has sufficient structural integrity to withstand external and internal load forces normally encountered by underground storage tanks without suffering significant cracking or collapsing. The construction of the composite wall which is adhered to the storage tank wall is responsible for the walls remaining held together even when elevated internal pressures between the walls are experienced.

The closed communication paths within the composite wall can be monitored. The full tank system can be monitored. Alternatively, selected tank system areas such as within support ribs, end wall areas or side wall areas can be selectively monitored if desired. For example, an access tube (not shown) extends from ground level through the resinous material of the composite wall so as to be in communication with at least one communication path. Any well known and commercially available monitor means can be used. For example, the closed communication paths can be filled with a detecting liquid. This detecting liquid can be placed in the closed paths by the manufacturer of the tank. At the end of the access tube is a sight glass. Whenever leakage occurs, a change in the level of a detecting liquid will occur and will be readily observed in the sight glass. Instead of the sight glass and visual observation of a change in level of detecting liquid, and in fact more preferably, non-visual leak detection means such as a pressure transducer is used to detect a change in level.

Alternatively, the closed communication paths of the storage tank system are placed either under a non-atmospheric pressure, i.e. a positive or negative air pressure. Detection means associated with the closed communication paths is capable of detecting any change in pressure resulting from the leak in the composite wall or the storage tank. A conventional air pump or vacuum pump, together with an associated pressure regulator can be used. A pressure change sensor is a part of the detection means. A pressure gauge serves this purpose adequately. Optionally, an alarm system is electronically linked with the pressure sensor to audibly or visually warn of a pre-set significant pressure change. The volume of the closed communication paths remains substantially constant and is conducive to the use of pressure or vacuum.

Another embodiment of the detection means utilizes an analyzer capable of detecting the liquid being stored. Thus, the detection means comprises the analyzer which is in communication with the closed communication paths. A vacuum means for withdrawing gaseous material from the closed paths is used for the purpose of obtaining a sample. Still another detection means utilizes a probe which extends through an access tube so as to monitor for leakage, preferably at or near the bottom of the tank system where leakage will gravitate. The probe is capable of detecting pre-selected liquids or gases.

Figure 5:
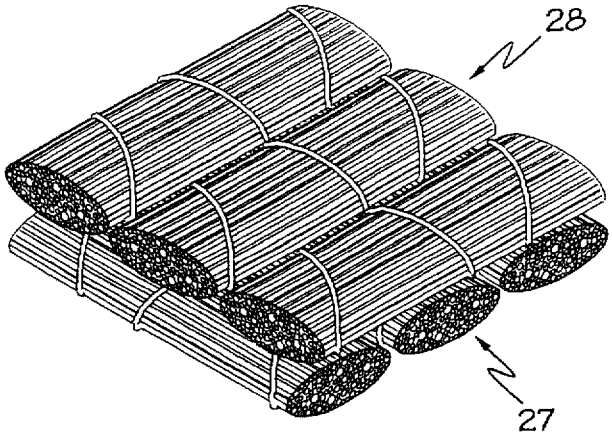
FIG. 5 is a perspective view of a base layer and a cross layer of filament bundles which are used in building another storage tank system of the invention.
Figure 6:
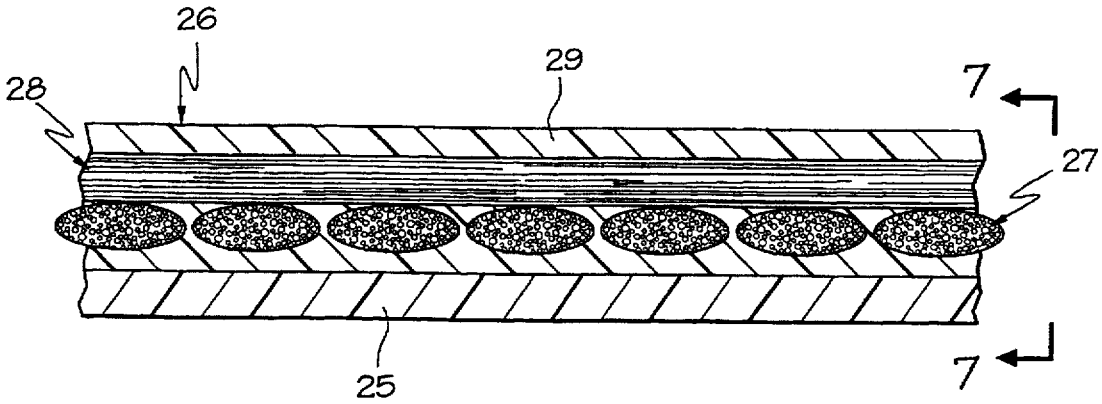
FIG. 6 is an enlarged partial side view in section of a storage tank system of the invention showing in detail a storage tank wall with an overlying composite wall using the base layer and cross layer of filament bundles of FIG. 5.
Figure 7:
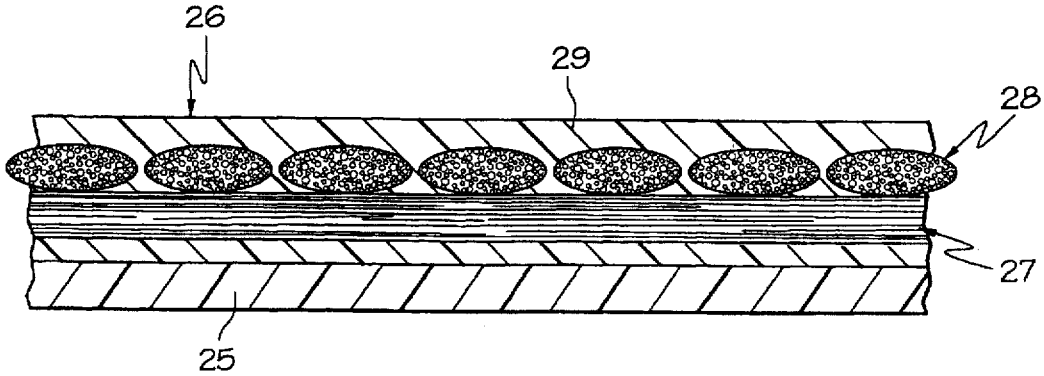
FIG. 7 is a partial end view of the storage tank system of FIG. 6 taken along line 7—7 thereof.

FIGS. 5–7 illustrate an embodiment of the invention wherein two layers of filament bundles are used in formation of a storage tank system having an inner storage tank 25 and a composite wall 26. A base layer 27 and a cross layer 28 of filament bundles are utilized in the composite wall 26 to enhance detection of any leakage. For purposes of illustration, FIG. 5 shows the two layers isolated from the tank system. The two layers depicted are identical in filament bundles characteristics and are as described above with respect to the base layer of FIG. 3. However, the cross layer 28 is positioned over the base layer 27 such that the respective filament bundles run at substantially 90 degree angles to one another. Stitching and, optionally, a fibrous backing sheet of non-woven fibrous material is loosely attached to the base layer 27 and the cross layer 28. The resinous material 29 used in forming the composite wall 26 with the two layers of filament bundles are as above described in composition and mode of formation. It should be apparent that a greater number of flow paths are provided. Furthermore, the paths run in two directions. As a consequence, leakage in one area of the storage tank system which is initially found in one flow path is readily transmitted to a leak detection area by way of the two sets of flow paths.

Figure 8:
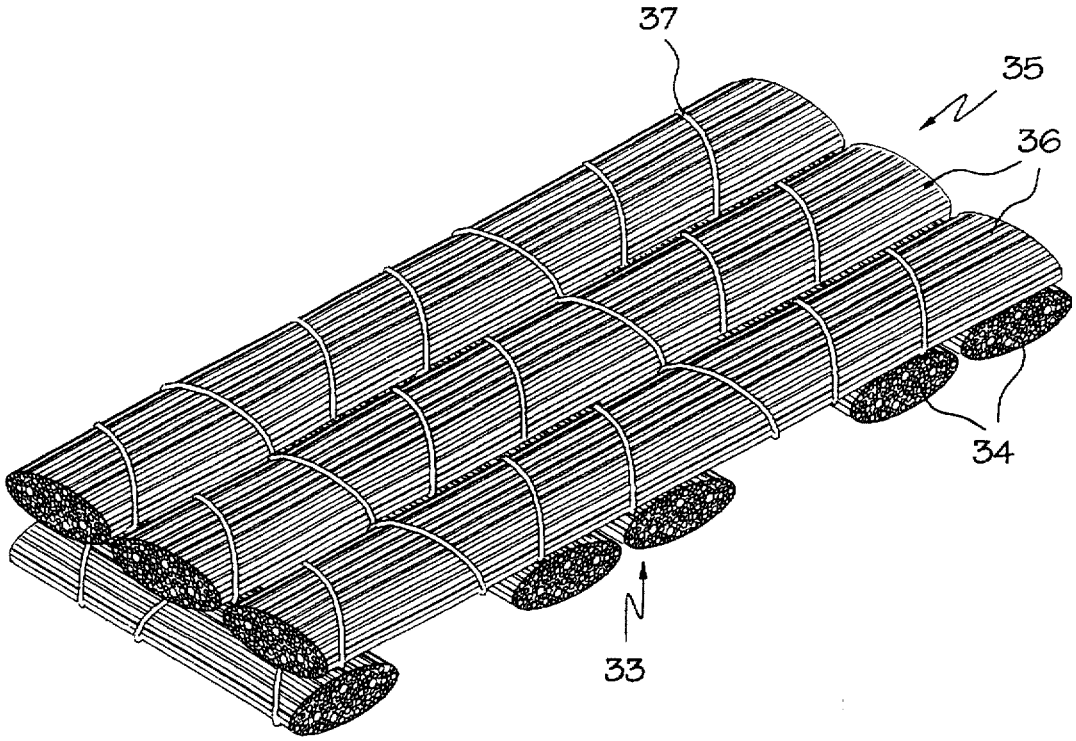
FIG. 8 is a perspective view of another base layer and cover layer of filament bundles.
Figure 9:
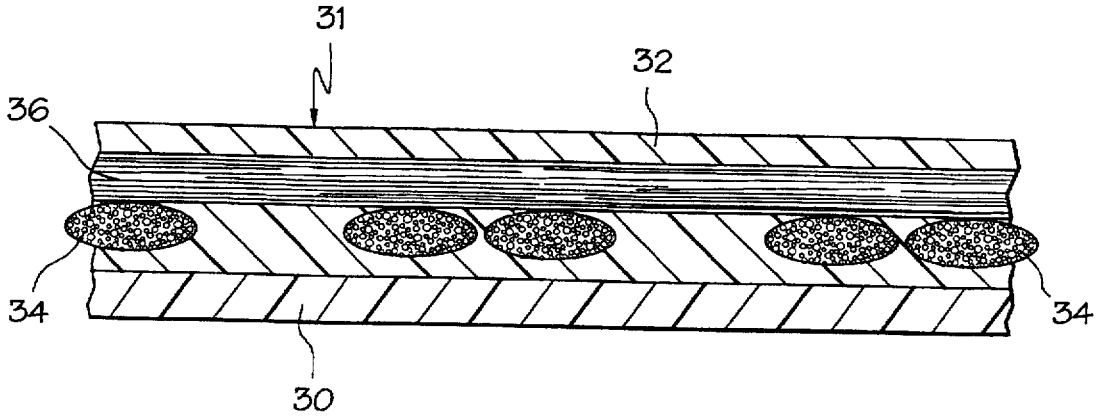
FIG. 9 is an enlarged partial side view in section of a storage tank system of the invention showing in detail a storage tank wall with an overlying composite wall using the base layer and cross layer of filament bundles of FIG. 8.

FIG. 8 illustrates another array of filament bundles and FIG. 9 illustrates a section taken from another storage tank system using the filament bundles. The storage tank system has a fibrous reinforced resinous material inner storage tank 30 and an overlying composite wall 31. The composite wall 31 is made of a resinous material 32, a base layer 33 of filament bundles 34 and cross layer 35 of filament bundles 36. The physical characteristics of the individual bundles are the same as those filament bundles described above with references to FIG. 5–7. However, the filament bundles are held together by stitching 37 in a manner resulting in a more loose array of bundles. The looser array of bundles results in a stronger composite wall without a significant loss of leak detection capability through the individual filament bundles.

With reference to FIG. 8, the filament bundles 34 in the base layer 33 are arranged to have gaps between bundles of at least about 2 mils, preferably about 75 mils to about 2,000 mils. In addition, more preferably a large gap of about 1,000 mils is provided between each set of two filament bundles in the base layer. The filament bundles 36 in the cross layer 35 are more evenly spaced with a gap of at least about 2 mils, preferably about 75 mils to about 250 mils between each bundle.

Figure 10:
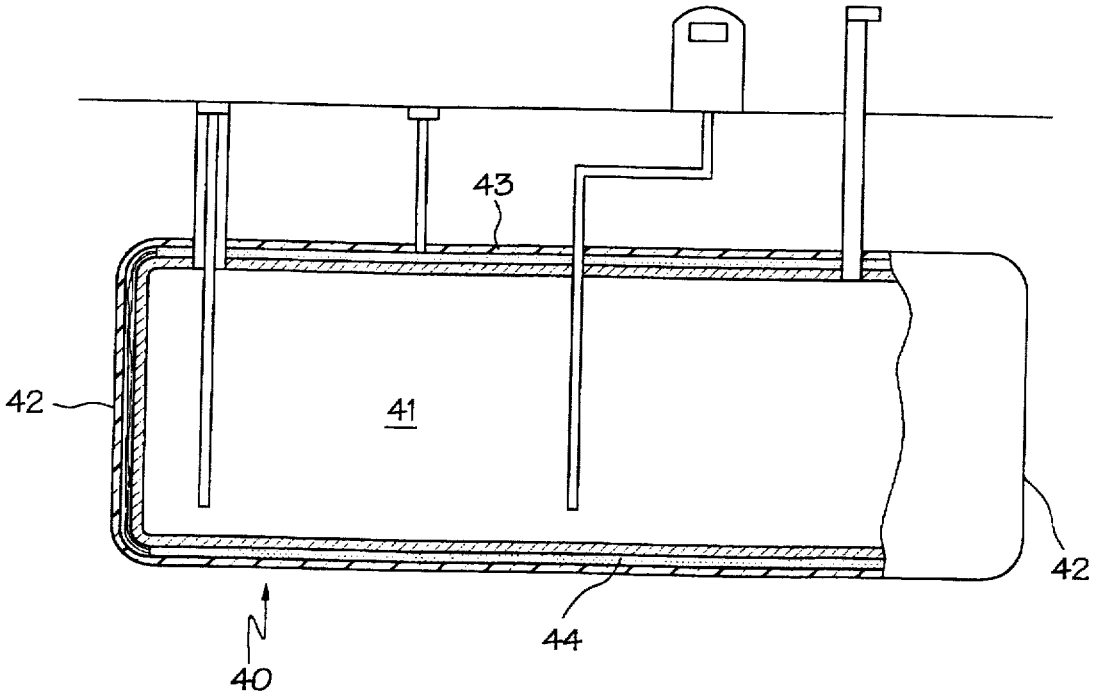
FIG. 10 is a side view in partial section of a storage tank system of the invention having a steel inner tank and outer composite walls over the inner tank's end walls for enhanced end wall strength and an outer wall over the inner tank's side walls for secondary containment purposes.

FIG. 10 illustrates an embodiment of the invention wherein the composite wall is used only on the end walls of a storage tank forming a part of a storage tank system 40. As shown, the inner storage tank 41 is a conventional metal storage tank made from steel. Steel storage tanks are often built with flatten end walls. These end walls can experience greater load forces than the main body side wall of the tank, e.g. when the closed space between the walls is filled with detection liquid or air pressure by the manufacturer at the factory. Accordingly, it is particularly advantageous that the strength of the end walls be enhanced. A composite wall 42 is formed on each of the end walls to cover them. The coverage can be full or partial. Preferably, a continuous wall 43 also extends over the cylindrical-shaped main body side wall of the tank 41 and connects to the composite walls 42 such that full secondary containment of the inner storage tank is provided. As shown, a conventional separating material 44 such as a polymeric foam or another separating material is used between the side wall of the inner tank 41 and the continuous wall 43. This embodiment of the invention is important in providing full secondary containment with leak detection capability.

Figure 11:
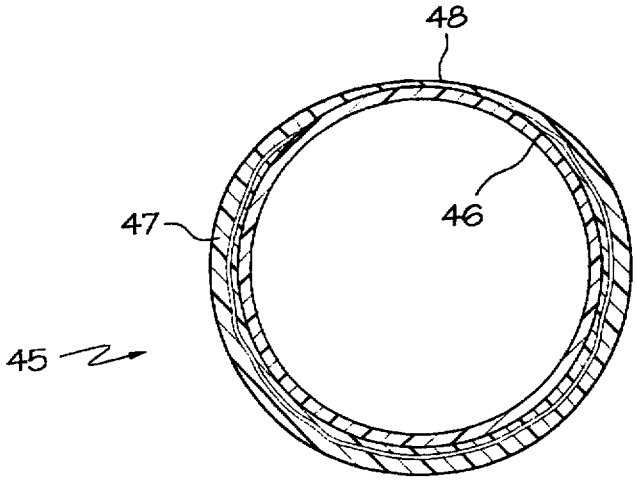
FIG. 11 is a side view of another storage tank system of the invention wherein a composite wall provides coverage of a lower portion of an inner tank.

A lower portion only of a conventional steel or fibrous reinforced resinous tank wall can have a composite wall applied to effect a partial covering. With regard to FIG. 11, a storage tank system 45 of the invention is shown wherein a composite wall covers only a portion of an inner tank. The inner tank 46 is made of fibrous reinforced resinous material and is ribbed. A composite wall 47 of resinous material and filament bundles covers only a lower portion of the inner tank 46, i.e. it provides about 270 degrees to about 340 degrees coverage. Excess resinous material used in forming the composite wall 47 can overlap onto the top portion of the inner tank 46. The single wall top center-line area 48 of the tank system is used for piping accesses.

Figure 12:
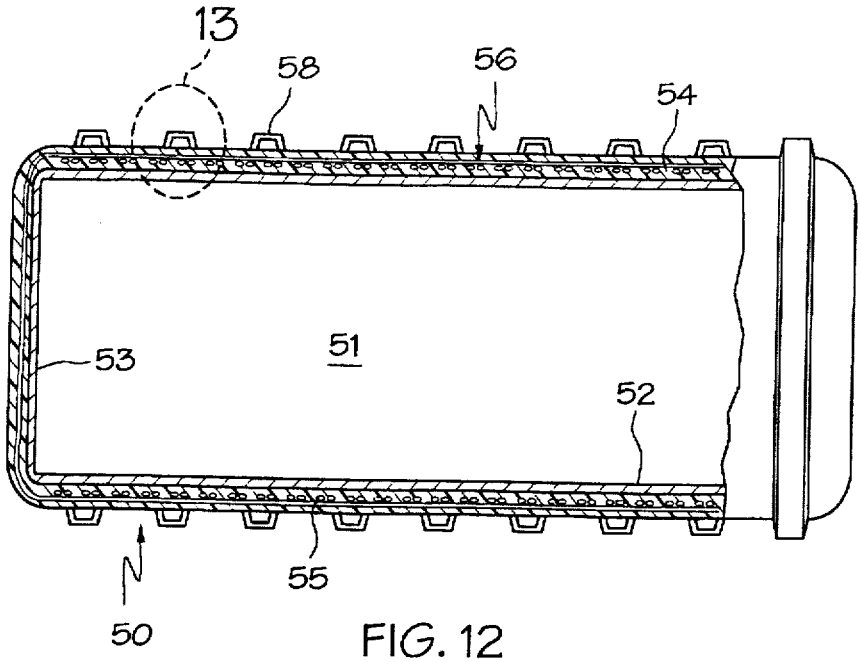
FIG. 12 is a side view in partial section of another storage tank system of the invention having a steel inner tank and an outer composite wall substantially covering the inner tank and further having circumferentially extending support ribs on the outer composite wall.
Figure 13:
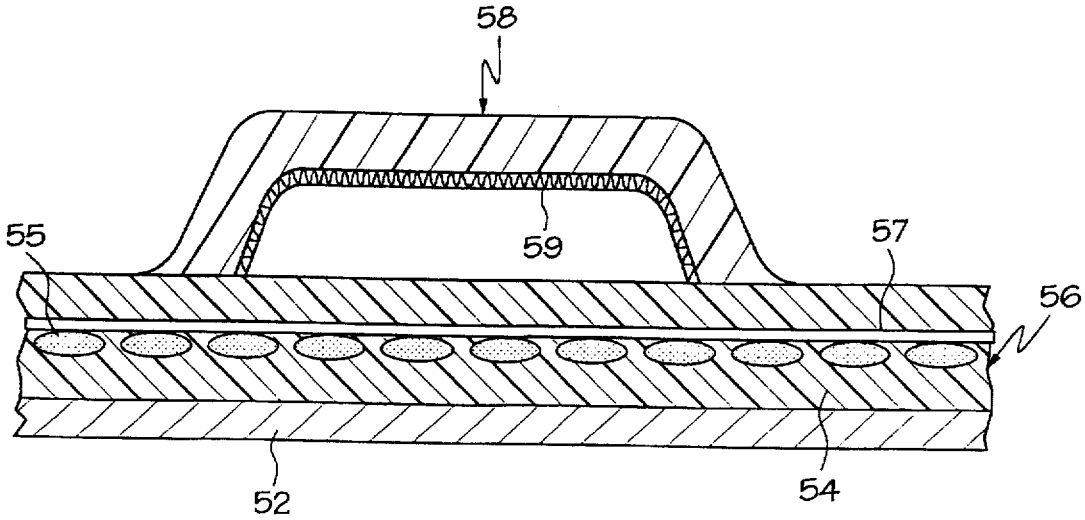
FIG. 13 is an enlarged partial side view in section of the storage tank system of FIG. 13 taken along dotted line 13 thereof.

With reference to FIGS. 12 and 13, there is shown an embodiment of the invention wherein outer support ribs are used to further enhance the structural strength of the storage tank system 50. A steel inner tank 51 is used in the system. It has a cylindrical-shaped main body side wall 52 and flat end walls 53. A resinous material 54 is applied to the inner tank. Next, a base layer 55 of filament bundles is embedded in the resinous material while still tacky in a manner similar to that described in FIGS. 1–5. Additional resinous material is applied over the base layer 55 to form a composite wall 56. Preferably, a communication strip 57 of porous material is positioned along the top of the tank system so as to contact the base layer filament bundles to enhance each detection capability. In accord with this embodiment of the invention, a set of circumferentially extending support ribs 58 are positioned on the composite wall 56 and secured thereto. Preferably, the ribs are uniformly spaced and have on-center spacings ranging from about six inches to about twenty-four inches.

The support ribs are conventional in nature. They are typically formed by positioning a rib form 59 on the composite wall 56 and then applying fibrous reinforced resinous material in sufficient thickness to create a rigid structure securely attached to the continuous wall. As shown, the fibrous reinforced resinous material overlaps onto the composite wall. The support ribs can also be formed from foam molds which are hollow or solid. As with the cardboard forms, the foam molds are positioned around the continuous wall and fibrous reinforced resinous material applied. In all instances, the resultant ribs are rigid and are permanently attached to the composite wall 56 of the storage tank system 50.

Figure 14:
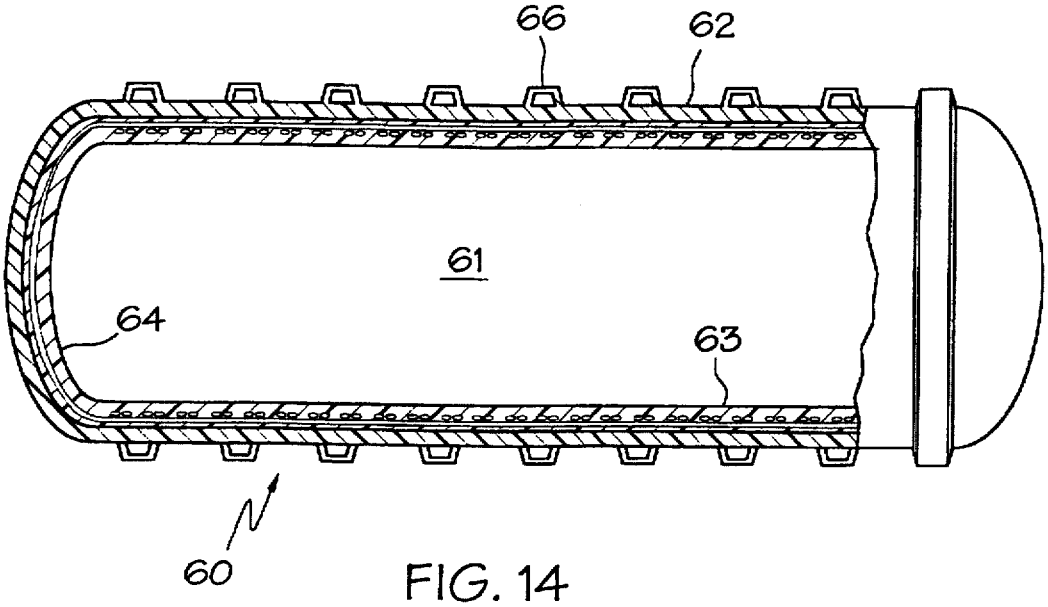
FIG. 14 is a side view in partial section of still another storage tank system of the invention having an inner tank and an outer composite wall each of fibrous reinforced resinous material with circumferentially extending support ribs.

FIG. 14 illustrates a storage tank system 60 of the invention wherein both the inner tank 61 and an outer composite wall 62 are made of a fibrous reinforced resinous material. The inner tank 61 has a cylindrical-shaped main body side wall 63 and dome-shaped end walls 64. In accord with the invention, the composite wall 62 substantially covers the side walls and the end walls. Additionally, and for the reason discussed above with reference to FIGS. 12 and 13, a set of support ribs 66, preferably uniformly spaced, extend around the composite wall 62 and are bonded thereto. As shown, each support rib 66 extends circumferentially around the composite wall. There could also be used a single spiral-shaped support rib which extends the length of the continuous wall.

The tank system 60 is made using known tank building techniques readily adapted to use the herein described invention. For example, a reuseable mold is initially used to form two half tanks which are subsequently removed from the molds and joined together. The composite wall is formed on its outer surface and the support ribs added. The tank system could as well be built from outside using known tank building techniques.

Figure 15:
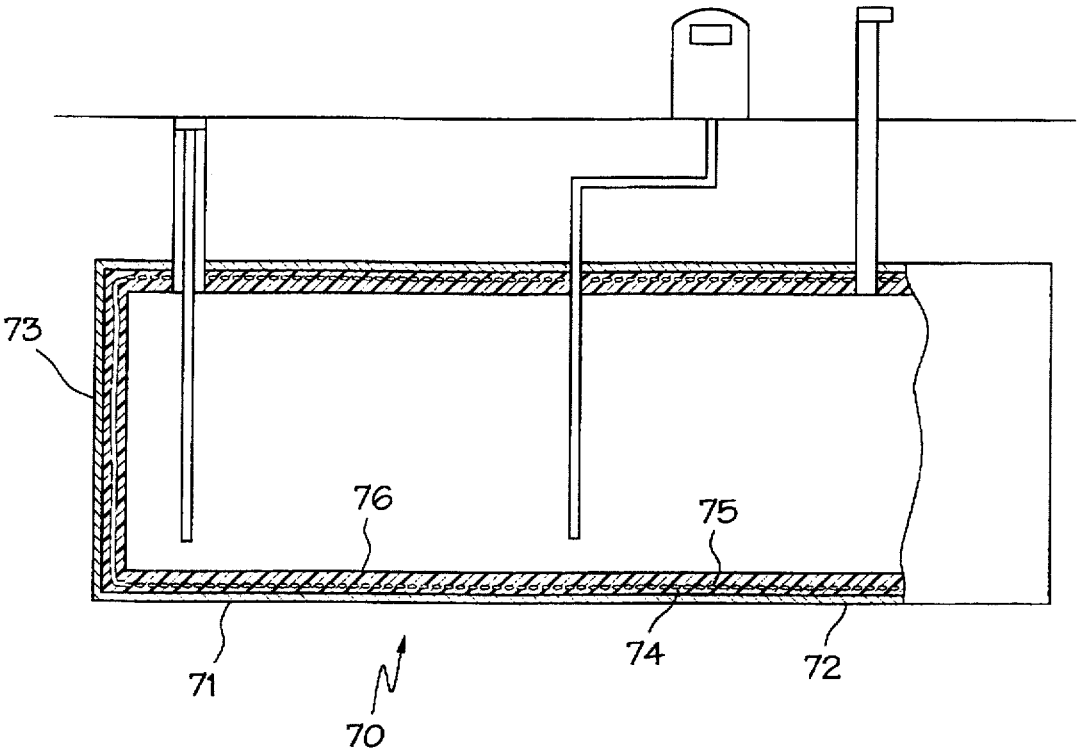
FIG. 15 is a side view in partial section of a storage tank system wherein a buried steel tank is retrofitted with an inner composite wall in accordance with the invention.
Figure 16:
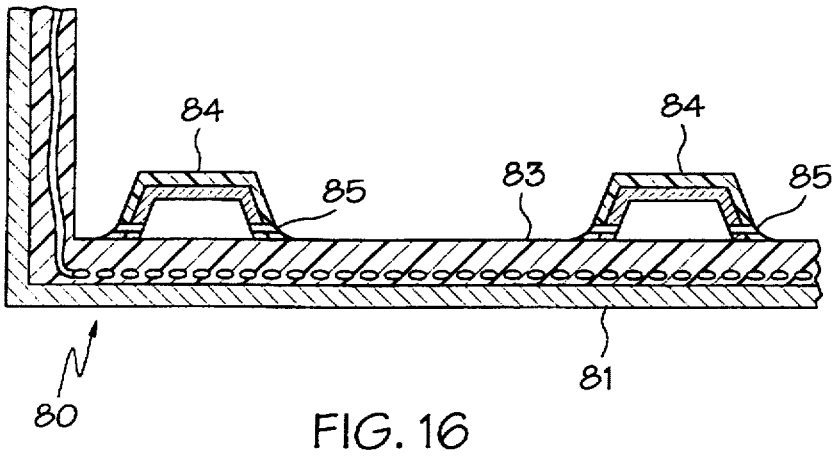
FIG. 16 is an enlarged partial side view in section of still another storage tank system of the invention with a steel tank having an inner composite wall and internal support ribs made in accord with this invention.
Figure 18:
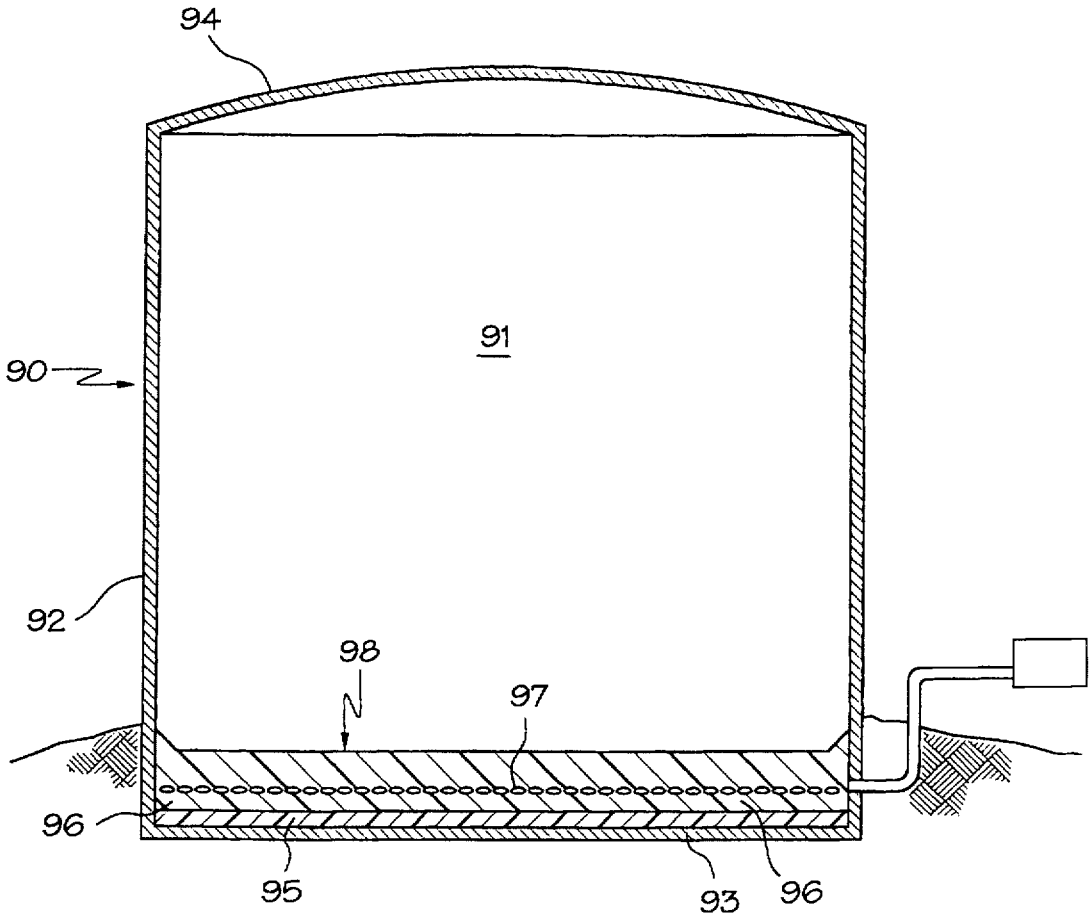
FIG. 18 is an above ground vertically disposed storage tank system of the invention with a storage tank and composite wall over the storage tank's bottom wall.

The embodiments of this invention illustrated in FIGS. 15 and 16 utilize an existing underground storage tank as a matrix tank in forming a storage tank system. The matrix tank is a metal tank or a fibrous reinforced resinous tank having a cylindrical-shaped main body and end caps. The end caps shown are flat, though can as well be dome-shaped. Such tanks represent a very conventional design. Each will have typically been field tested to ascertain a leakage problem which needs to be rectified. Any major corrosion damage or crack in the matrix tank can first be repaired, though need not be. The method of this invention lends itself particularly well to the formation of an in situ storage tank system in an existing buried tank which is in need of rejuvenation. The resultant formed inner tank is fully capable of independently containing liquid. When internal support ribs are added as shown in FIG. 18, the formed inner tank is also independently capable of withstanding normal load forces.

With reference to FIG. 15, there is shown an in situ formed storage tank system 70 of the invention. The composite wall of the system is formed inside an existing matrix tank 71. The matrix tank 71 comprises a cylindrical-shaped main body side wall 72 and end walls 73. The side wall 72 and end walls 73 are made of metal, preferably steel. The interior of the matrix tank is a smooth walled cylindrical-shaped container. In this embodiment, any sludge or other contaminate material is initially removed from the matrix tank 71. Preferably, the entire interior surface of the tank is abrasively cleaned by sand-blasting to remove foreign substances and to roughened the surface to better serve as a temporary surface while, as further discussed below, an intermediate partition is bonded thereto and a continuous wall is formed. Any access lines such as used for filling, dispensing and venting purposes are temporarily disconnected and any openings capped or masked over.

A liquid resinous material 74 is initially applied to fully cover the interior surface of the cylindrical-shaped main body side wall 72 and end walls 73 of the matrix tank 71. The resinous materials described above are used. Its viscosity is adjusted so that after its application to the matrix tank walls and prior to cure, a base layer 75 of filament bundles can be laid thereon and only partially embedded. Additional resinous material is added as needed. The portion of the composite wall 76 away from the base layer contains fibrous material. The fibrous material when used is of the same physical shape and structure as described above as is the resinous material. There are several known ways of producing a structurally sound continuous wall of resinous and fibrous materials. The particular way selected is not important.

FIG. 16 is another in situ formed storage tank system 80 of the invention. It has a steel outer tank 81 and an inner composite wall 83 formed as above described with respect to FIG. 15. Additionally, internal support ribs 84 extend circumferentially around the inside of the tank. The support ribs 84 are positioned around the inside of the cylindrical-shaped main body portion of the composite wall 83 and are secured thereto. The support ribs 84 are preferably uniformly spaced along the wall and protrude inwardly. A centerline spacing of from about four inches to about thirty inches is preferred. A closer spacing tends to result in a stronger tank, though the added costs may not be justified. The support ribs 84 made of a fibrous reinforced resinous material are typically formed in a manner described above with reference to FIGS. 12 and 13.

The internal support ribs of the storage tank system 80 add strength needed to withstand earth load stresses. Such ribs when properly formed and secured to the cylindrical-shaped composite wall 83 results in a storage tank which is capable of withstanding load forces normally encountered. The formed tank has sufficient strength without any strengthening contribution from the matrix tank.

Each internal support rib 84 of the storage tank system shown in FIG. 16 has apertures 85 extending through both side walls at or near a lowermost point in the formed tank. The purpose of the apertures is to allow stored liquid to flow freely to avoid pools of liquid between the ribs. Apertures in the support ribs at an uppermost point (not shown) are also beneficial in that they allow vapors to flow freely to avoid trapped vapors when the tank is substantially full. While not shown, a smooth continuous innermost wall can be installed at least on top of the internal support ribs 84 at the ribs' lowest point in the formed tank. At least about 10% of the support ribs' top surface area is covered by the innermost wall. The purpose of this wall is to provide a smooth bottom whereby stored liquid is readily accessed for dispensing purposes. The innermost wall can as well extend completely around the inside of the tank system to fully cover the support ribs.

Figure 17:
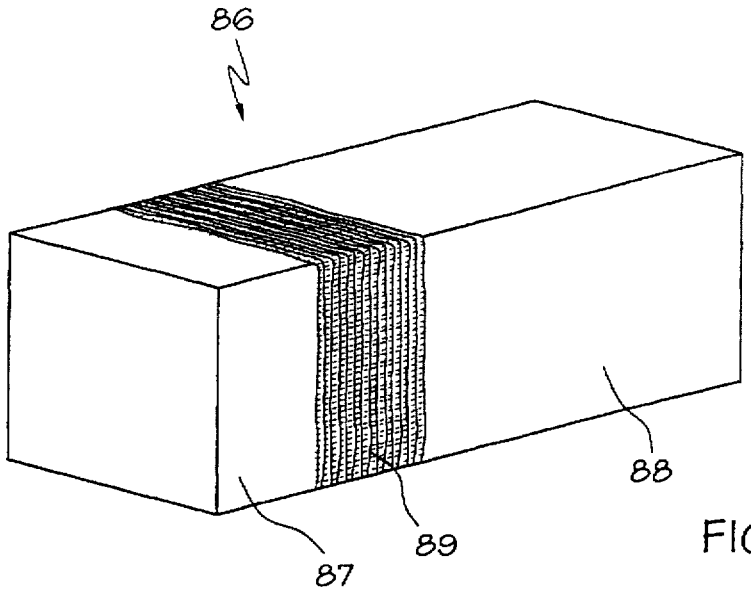
FIG. 17 is a view in perspective of an above ground storage tank system of the invention having an inner tank vault with flat side walls and flat end caps and an outer composite wall thereover.

FIG. 17 illustrates a storage tank system 86 of the invention which has a rectangular-shaped inner tank vault 87 with flat side walls and end walls. A composite wall 88 partially stripped away in FIG. 17 to expose a base layer 89 of filament bundles, substantially fully covers the inner tank. The tank system 86 is particularly suited as an above ground storage tank system which can be further encased in concrete and used at retail gasoline service stations.

With reference to FIG. 18, there is shown an above ground storage tank system 90 of the invention. A storage tank 91 forming a part of the system is made of metal and has a cylindrical-shaped side wall 92, a flat bottom wall 93 and a generally domed-shaped top wall 94. The top wall 94 as shown is permanently attached to the side wall. Floating top walls which rest on the stored liquid are also commercially available and feasible in this invention. Inlet and outlet piping as well as a manway in the top or side wall which are typically present are not shown. The invention is useful with storage tanks made of other rigid materials, particularly fibrous reinforced resinous material. Other shapes of tanks also utilize the invention. However, this embodiment of the invention is particularly suited to the metal cylindrical-shaped tanks having the flat bottom wall and, for this reason, is described in detail.

The storage tank 91 is commercially available. Such tanks are available in capacities holding at least about 10,000 gallons of liquid. An optional liner 95 is initially added across the flat bottom wall 93 and secured thereto, at least at its edges. The liner 95 is particularly useful with used storage tanks which are in need of repair or with new tanks where an added measure of bottom wall integrity is desired. The liner 95 is a material which is resistant to the liquid being stored. Examples of suitable liners include materials made of polyepoxies, polyesters, vinylesters and polyurethanes. Other examples include synthetic resins which are capable of being sprayed, trowelled or poured onto the bottom wall and cured.

A resinous material 96 and a base layer 97 of filament bundles as above described are next added over the storage tank's flat bottom wall, including any optional liner, and preferably partially up its side wall. Another application of resinous material is applied to form a composite wall 98. The second application of resinous material is preferably reinforced with a fibrous material. It is formed by applying a layer of the resinous and fibrous reinforcing materials on the added resinous material in the manner discussed above.

It should be apparent the tank systems of the invention lend themselves to effective monitoring. Any type of failure in the tank wall or the composite wall will be readily detected. Stored liquid, ground water or a change in gaseous content or pressure is detectable regardless of where the failure may have occurred. Even the approximate location of a wall failure is determinable when two or more closed communication paths are created. For example, an annular closed communication space can be structurally isolated from a planar closed communication space as exists between an end wall and its overlying composite wall.

The tank systems of the invention are adaptable to enhanced leak detection by the use of independent open flow path means positioned in close association with a tank wall. For example, a tube with receiving holes in its wall or a half-round tube can be installed adjacent a tank wall or composite wall at one or more strategic locations to detect some change in the local environment. Any change is immediately transmitted to a monitoring station. Other open flow means can be used in conjunction with the closed communication flow paths provided in the filament bundles of the base layer and optional cross layer to result in a tank system with the capability of alerting its owner to a leakage problem soon after the problem comes into being.

The invention has been described with particular reference to the drawings. A detailed description has been given for production of the composite wall. Other manners of applying the base layer of filament bundles, cross layer of filament bundles and/or resinous material can be used. For example, the base layer and the cross layer can be positioned on a tank wall so that the individual filament bundles run vertically, horizontally, and at angles to the tank wall. The resinous material which encapsulates the array to form the flow paths can be applied all in one step or several steps and by different techniques. It can all be applied to the tank wall in one step and then the base layer pushed down into it. Resinous material can also be applied to the tank wall, the base layer positioned on it and then more resinous material applied. These and other variations of the invention of an obvious nature are considered within the scope of the appended claims.

What is claimed is:

1. A storage tank system having a closed communication space between two closely associated discreet walls, said storage tank system comprising:

(a) a storage tank having a main body side wall and attached end walls at each end thereof; and (b) an overlying composite wall of (1) a resinous material and (2) a base layer of discreet filament bundles running generally in one direction whereby the resinous material encompasses the base layer of discreet filament bundles and at least partially penetrate between individual bundles while a mid-portion of each said filament bundle is substantially resin-free to provide flow paths for the detection of leakage.

2. The storage tank system of claim 1 wherein the layer of discreet filament bundles is formed from bundles of fiberglass filaments loosely held together by stitching to maintain each bundle's integrity.

3. The storage tank system of claim 2 further wherein the layer of discreet filament bundles is held together during installation by a non-woven fibrous backing sheet.

4. The storage tank system of claim 3 wherein the base layer of discreet filament bundles has a yield of from about 8 oz. per square yard to about 54 oz. per square yard.

5. The storage tank system of claim 4 wherein the base layer of filament bundles has a yield of from about 24 oz. per square yard to about 48 oz. per square yard.

6. The storage tank system of claim 2 wherein each of the filament bundles is sufficiently dense so as to prevent the penetration of resin into its mid-portion thereof.

7. The storage tank system of claim 1 further wherein at least one high speed communication strip of porous material is positioned over the base layer of discreet filament bundles so as to run at an approximate 90 degree angle to said discreet filament bundles to interconnect therewith and extends to a central leak detection station to aid in the quick detection of leakage in either the storage tank or the composite wall.

8. The storage tank system of claim 1 further wherein a cross layer of discreet filament bundles running generally in one direction is positioned over the base layer of discreet filament bundles so that the discreet filament bundles of the cross layer are at a substantially 90 degree angle to the discreet filament bundles of the base layer so as to form interconnecting flow channels.

9. The storage tank system of claim 1 wherein the tank is formed from a fibrous reinforced resinous material and further has a set of spaced support ribs positioned on the main body side wall.

10. The storage tank system of claim 1 wherein the tank is formed from steel.

11. The storage tank system of claim 1 wherein the composite wall follows the contour of the outside of the tank.

12. The storage tank system of claim 11 further wherein the tank has a cylindrical-shaped main body side wall and further has a set of substantially uniformly spaced support ribs positioned on the continuous wall overlying said cylindrical-shaped main body side wall of the tank and extending circumferentially therearound.

13. The storage tank system of claim 1 wherein the composite wall overlies the main body side wall of the tank.

14. The storage tank system of claim 1 wherein the composite wall overlies each end wall of the tank.

15. The storage tank system of claim 1 wherein the overlying composite wall is disposed over a lower about 270 degree to about 340 degree portion of the main body side wall of the tank.

16. The storage tank system of claim 1 wherein the composite wall is disposed substantially over the main body side wall and the end walls of the tank.

17. The storage tank system of claim 1 wherein the discreet filament bundles have gaps therebetween of at least about 2 mils.

18. A storage tank system having primary and secondary containment capability and a closed communication space for detecting leakage, said storage tank system comprising:

(a) a storage tank; and (b) a composite wall adhered to the tank, said composite wall made of (1) a resinous material and (2) a base layer of discreet filament bundles therebetween running generally in one direction, whereby the resinous material encompasses the layer of discreet filament bundles and at least partially penetrate between individual filament bundles to substantially encapsulate each said filament bundle while a mid-portion of each said filament bundle is substantially resin-free to provide flow paths for the detection of leakage.

19. A storage tank system having a closed communication space between two closely associated discreet walls, said storage tank system comprising:

(a) a storage tank having a main body side wall and attached end walls at each end thereof; and (b) an overlying composite wall of (1) a resinous material and (2) a base layer of discreet filament bundles running generally in one direction wherein said base layer has a yield of from about 8 oz. per square yard to about 54 oz. per square yard and whereby the resinous material encompasses the base layer of discreet filament bundles and at least partially penetrates between individual bundles while a mid-portion of each said fibrous bundle is substantially resin-free to provide flow path for the detection of leakage.

20. A storage tank system having a closed annular space between two closely associated discreet walls for detection of leakage resulting from damage to a wall, said storage tank system comprising:

(a) a storage tank having a cylindrical-shaped main body side wall and attached end walls at each end thereof; and (b) a composite wall which substantially follows the contour of each end wall of the storage tank, said composite wall having (1) a resinous material and (2) a base layer of discreet filament bundles running generally in one direction, whereby the resinous material encompasses the layer of discreet filament bundles and at least partially penetrate between individual bundles while a mid-portion of each filament bundle is substantially resin-free to provide flow paths for the detection of leakage.

21. The storage tank system of claim 20 wherein the layer of filament bundles has a yield of from about 8 oz. per square yard to about 54 oz. per square yard.

22. The storage tank system of claim 20 wherein the tank is formed from steel and the composite wall is fibrous reinforced.

23. The storage tank system of claim 20 wherein the discreet filament bundles have gaps therebetween of at least about 2 mils.

24. The storage tank system of claim 20 wherein the layer of discreet filament bundles is formed from bundles of fiberglass filaments loosely held together by stitching to maintain each bundle's integrity.

25. The storage tank system of claim 24 further wherein the layer of discreet filament bundles is held together during installation by a non-woven fibrous backing sheet.

26. The storage tank system of claim 24 wherein each of the discreet filament bundles is sufficiently dense so as to prevent the penetration of resin into its mid-portion thereof.

27. A storage tank system having a closed communication space between two closely associated discreet walls for the detection of leakage resulting from damage to a wall, said storage tank system comprising:

(a) a storage tank having a cylindrical-shaped main body side wall and attached end walls at each end thereof; and (b) a composite wall which substantially follows the contour of the storage tank to substantially cover said tank with an annular space therebetween said composite wall having (1) a resinous material and (2) a base layer of discreet filament bundles running generally in one direction, whereby the resinous material encompasses the layer of discreet filament bundles and at least partially penetrate between individual bundles while a mid-portion of each filament bundle is substantially resin-free to provide a flow path for the detection of leakage.

28. The storage tank system of claim 27 wherein the base layer of filament bundles has a yield of from about 8 oz. per square yard to about 54 oz. per square yard.

29. The storage tank system of claim 27 wherein the composite wall follows the contour of the outside of the tank.

30. The storage tank system of claim 27 wherein the composite wall follows the contour of the inside of the tank.

31. The storage tank system of claim 27 wherein the discreet filament bundles have gaps therebetween of at least about 2 mils.

32. The storage tank system of claim 27 wherein the layer of discreet filament bundles is formed from bundles of fiberglass filaments loosely held together by stitching to maintain each bundle's integrity.

33. The storage tank system of claim 32 further wherein the layer of discreet filament bundles is held together during installation by a non-woven fibrous backing sheet.

34. The storage tank system of claim 32 wherein each of the discreet filament bundles is sufficiently dense so as to prevent the penetration of resin into its mid-portion thereof.

35. A storage tank system having a closed communication space between two closely associated discreet walls for the reception of leakage resulting from damage to a wall, said storage tank system comprising:

(a) a storage tank having a cylindrical-shaped main body side wall and attached end walls at each end thereof; and (b) a composite wall which substantially follows the interior contour of the storage tank and covers at least a portion thereof, said composite wall having (1) a resinous material adhered to the tank, (2) a base layer of discreet filament bundles running generally in one direction and (3) a cross layer of discreet filament bundles running generally in one direction positioned over the base layer of discreet filament bundles so that the discreet filament bundles of the cross layer are at a substantially 90 degree angle to the discreet filament bundles of the base layer, whereby the resinous material encompasses the base and cross layers of discreet filament bundles and at least partially penetrate between individual bundles whereby a mid-portion of each filament bundle is substantially resin-free to provide flow paths for the detection of leakage.

36. The storage tank system of claim 35 wherein the base and cross layers of filament bundles each has a yield of from about 8 oz. per square yard to about 54 oz. per square yard.

37. The storage tank system of claim 35 wherein the storage tank is formed from a fibrous reinforced resinous material.

38. The storage tank system of claim 35 wherein the storage tank is formed from steel.

39. The storage tank system of claim 38 further wherein a set of substantially uniformly spaced support ribs are positioned on the composite wall overlying said cylindrical-shaped main body wall of the storage tank and extend circumferentially therearound.

40. A storage tank system having a closed communication space between two closely associated discreet walls for the detection of leakage resulting from damage to a wall, said storage tank system comprising:

(a) a storage tank having a cylindrical-shaped main body side wall and attached end walls at each end thereof;

(b) a composite wall which substantially follows the contour of the interior of the storage tank, said composite wall having (1) a first resinous material adhered to the tank (2) a base layer of discreet filament bundles therebetween running generally in one direction and (3) a fibrous reinforced resinous material adhered to the base layer, whereby the resinous material and the fibrous reinforced resinous material encompass the layer of discreet filament bundles and at least partially penetrate between individual bundles while a mid-portion of each filament bundle is substantially resin-free to provide flow paths for the detection of leakage; and (c) a set of internal support ribs securely bonded to the continuous wall overlying the storage tank's cylindrical-shaped main body wall.

41. The storage tank system of claim 40 wherein the base layer of filament bundles has a yield of from about 8 oz. per square yard to about 54 oz. per square yard.

42. The storage tank system of claim 40 wherein the tank is formed from steel.

43. An above ground storage tank system having a closed space between two closely associated discreet walls for detection of leakage resulting from damage to a wall, said storage tank system comprising:

(a) a storage tank having a cylindrical-shaped main body side wall and a substantially flat bottom wall; and (b) a composite wall which substantially follows the contour of at least the substantially flat bottom wall of the storage tank, said composite wall having (1) a resinous material adhered to the tank and (2) a base layer of discreet filament bundles therebetween running generally in one direction, whereby the resinous material encompasses the layer of discreet filament bundles and at least partially penetrate between individual bundles while a mid-portion of each filament bundle is substantially resin-free to provide flow paths for the detection of leakage.

44. The storage tank system of claim 43 wherein the base layer of filament bundles has a yield of from about 8 oz. per square yard to about 54 oz. per square yard.

45. The storage tank system of claim 43 wherein the tank is formed from steel and the resinous material of the composite wall is fibrous reinforced.

* * * * *